United States Patent [19]

Huang

[11] 4,429,682

[45] Feb. 7, 1984

[54] AUTOMATIC SAFETY GAS HEATING DEVICE

[76] Inventor: Ming F. Huang, No. 112, Ming-Te Rd., Pei-Tou District, Taipei, Taiwan

[21] Appl. No.: 352,892

[22] Filed: Feb. 26, 1982

Related U.S. Application Data

[63] Continuation-in-part of Ser. No. 267,349, May 26, 1981.

[30] Foreign Application Priority Data

Oct. 9, 1981 [TW] Taiwan ..... 6824923

[51] Int. Cl.[3] ..... F24H 1/00

[52] U.S. Cl. ..... 126/351; 236/21 R; 431/27; 431/46; 431/54; 431/66; 431/60; 122/448 R; 137/468

[58] Field of Search ..... 126/351, 374; 236/21 R, 236/25 A; 431/27, 46, 51, 54, 58, 60, 66; 122/504, 448 R; 251/11; 137/468

[56] References Cited

U.S. PATENT DOCUMENTS

| | | | |
|---|---|---|---|
| 2,258,590 | 10/1941 | Merten | 126/351 X |
| 2,312,479 | 3/1943 | Ray | 126/351 X |
| 2,371,020 | 3/1945 | Beam | 431/60 X |
| 2,879,358 | 3/1959 | Hilgert | 126/351 X |
| 4,055,164 | 10/1977 | Wu-Heng | 126/351 |
| 4,147,159 | 4/1979 | Thorwaldson | 126/351 |
| 4,267,820 | 5/1981 | Charron | 126/351 |

FOREIGN PATENT DOCUMENTS

| | | | |
|---|---|---|---|
| 930473 | 7/1955 | Fed. Rep. of Germany | 126/351 |
| 2804685 | 8/1979 | Fed. Rep. of Germany | 126/351 |
| 1559681 | 12/1967 | France | 126/351 |
| 55-75128 | 6/1980 | Japan | 126/351 |
| 2012408 | 7/1979 | United Kingdom | 126/351 |

*Primary Examiner*—Samuel Scott
*Assistant Examiner*—Randall L. Green
*Attorney, Agent, or Firm*—David M. Ostfeld

[57] ABSTRACT

A valve rod of a gas heating device actuates not only a microswitch, but also a disc valve. A pilot burner and a main burner are separately controlled by individual solenoid operated valve which is serially connected. The disc valve is provided at the upstream of the pilot burner, and between two solenoid operated valves for safeguarding against the erroneous on-state of the microswitch. A sensor will, according to the presence of the pilot flame, instruct an electric control board to continue or discontinue the sparkling of an igniter, to open or close the solenoid valve for supplying gas to the main burner. Thus, the adversity of toxication caused by either the misfunction of microswitch or failure of valve actuation is able to be prevented.

4 Claims, 3 Drawing Figures

AUTOMATIC SAFETY GAS HEATING DEVICE

CROSS REFERENCE TO RELATED APPLICATION

This application is a continuation-in-part application of U.S. application Ser. No. 267,349 filed on May 26, 1981.

BACKGROUND OF THE INVENTION

The present invention is related to an automatic safety gas heating device, more particularly, related to a gas heating device for producing instant hot water.

Conventionally, as the water pressure acts on a diaphram valve of a gas heating device to move a valve rod, the valve rod will not only actuate a microswitch to continue the sparkling of an igniter, but also simultaneously drive a first valve disc to open and admit the gas flowing to the nozzle of a pilot burner, thus igniting the gas thereat. As the pilot flame is produced, a catch which is controlled by a sensor, will be subsequently disengaged from a second valve disc of a gas conduit of the main burner so that the valve rod will subsequently drive the second valve disc to open and admit the gas flowing to the nozzle of the main burner and burning thereat. In such kind of gas heating device, no sooner than the pilot flame or the pilot flame together with the main flame are blown out by the wind, the igniter will re-ignite the gas from the pilot burner, and then fire the main burner as the above-mentioned operation steps. Hence no unburned gas can be permitted to flow out of the nozzle. The valve disc of the main flame will maintain in close state so long as the pilot flame is not able to be ignited. Therefore, in case the igniter fails to work, only a slight amount of the unburned gass will flow out of the nozzle of the pilot burner, thus resulting in a serious problem of suffocation and explosive burning. However, as the main and pilot flames are suddenly blown out by a strong wind, while immediate re-ignition is not available, a large amount of unburned gas will rush out of the nozzle of the main burner and cause explosive burning and suffocation. Moreover, in shortage of electricity the valve disc can not be automatically closed and a great deal of gas will escape from the nozzle of the main burner and pilot burner. Therefore, a further improvement still has to be attempted. In my U.S. patent application Ser. No. 267,349, an automatic safety gas heating device is devised to overcome the above drawbacks. In that device, a valve rod connecting to a diaphram valve does not control valves directly, instead, it merely actuates a microswitch for electric control board. The electric control board, in turn, controls the on-off state of the two solenoid operated valves which are connected in series. Two solenoid operated valves are so oriented that the valves are in closed state when the electric control board runs out of the electricity.

It is attempted in this invention to make safety improvements on the gas heating device specified in U.S. application Ser. No. 267,349, in which a disc valve is additionally provided thereto.

In accordance with the present invention, an automatic safety gas heating device comprises: a valve rod externally connecting to a diaphram valve which is exterted by the pressure of the water; a microswitch for an electric control board, actuated by the movement of the valve rod; a first and a second solenoid operated valves, connected in series, which are separately provided in a first gas conduit communicating with nozzles of a pilot burner and a second gas conduit communicating with nozzles of a main burner, the first and second solenoid operated valves separately actuated by the electric control board; a third valve provided in the first gas conduit and located between the first valve and an upstream of the nozzle of the pilot burner and the second valve, actuated by the movement of the valve rod; an igniter provided near the nozzle of the pilot burner, and actuated by the electric control board; and a first sensor provided in the vicinity of the nozzle of the pilot burner for detecting the presence of a pilot flame and inducing the electric control board to send signals, whereby as the valve rod actuates the microswitch to on condition and the third valve to open, the gas from the pilot burner will start to be ignited while the first valve is actuated to open, immediately after the pilot flame is produced, the sensor will induce the electric control board to send a first electric signal to discontinue the sparkling of the igniter and to open the second solenoid operated valve and supply the gas to the main burner and supply the gas to the main burner and ignited thereat; in the absence of the pilot flame, the sensor will induce the electric control board to send a second electric signal to continue the sparkling of the igniter, and to actuate the second solenoid operated valve and stop the gas supply to the main burner.

In accordance with another aspect of the present invention, the third valve having a valve disc thereof which is thrusted to open by the valve rod against a bias.

In accordance with further aspect of the present invention, in the vicinity of the main burner a temperature detecting sensor is provided for sending a signal to an alarm and simultaneously switching the elcetric control board off when the temperature is beyond a predetermined value.

It is a primary object of the present invention to provide a gas heating device, in which a valve disc is provided for cutting the supply of the gas to the gas burner in case the solenoid operated valve is misguided to open by an erroneous signal from the electric control board.

It is another object of the present invention to provide a gas heating device, in which the overheating of the gas burner can be avoided.

These and other objects will be apparent by illustrating a preferred embodiment with reference to the following drawings, in which:

DETAILED DESCRIPTION OF THE PREFERRED EMBODIMENT

Figure 1:
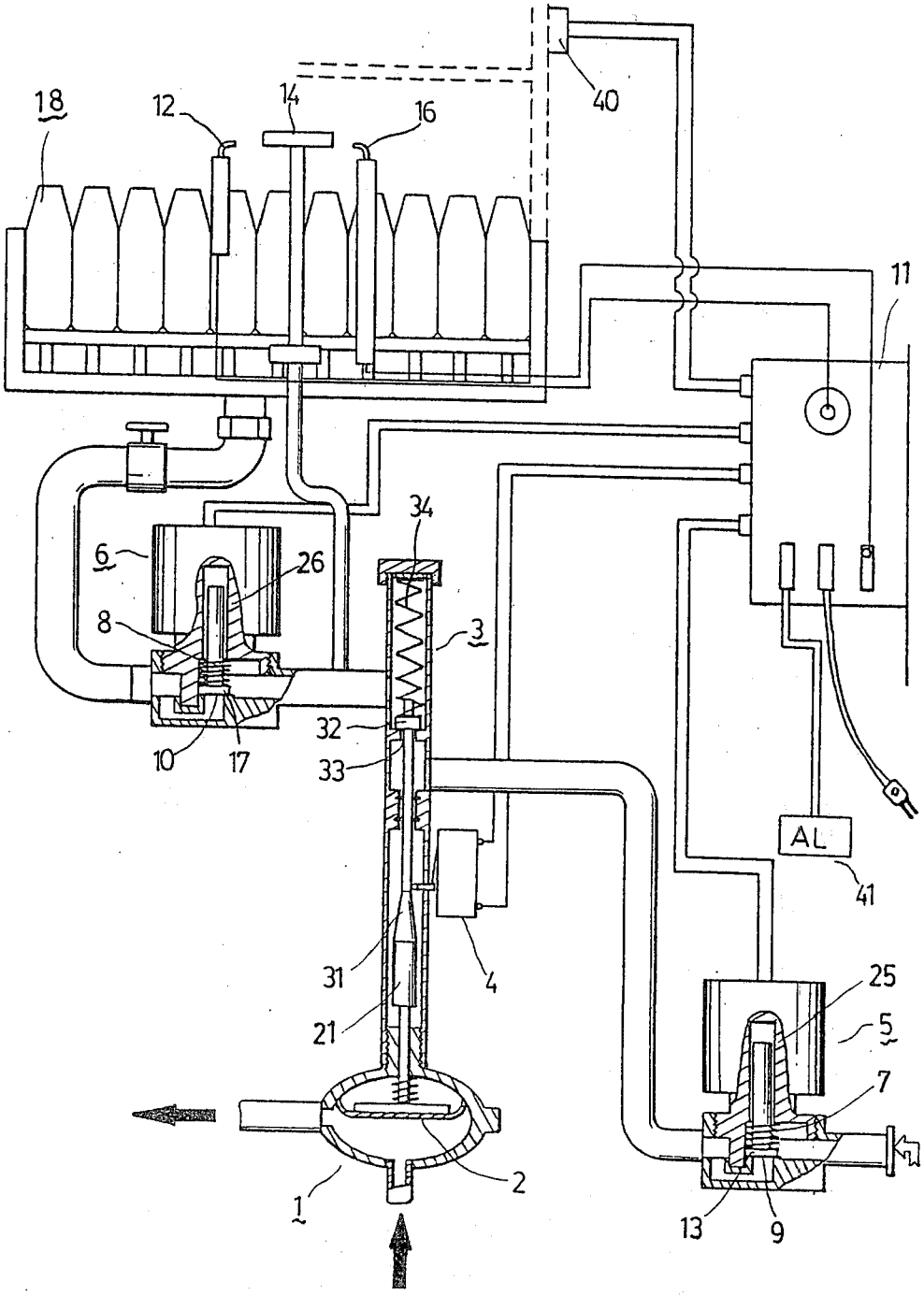
FIG. 1 is a schematic view illustrating a preferred embodiment in a state that the diaphragm valve is not thrusted by the water pressure.

As shown in FIG. 1, as a faucet (not shown) is closed, an elastomeric diaphragm 2 of a diaphragm valve 1 is not thrusted by the water pressure and thus sustains in its lower position. A valve rod 21 connecting to the elastomeric diaphragm 2 is not driven upward to actuate a microswitch 4 and a third disc valve 3, and thus an electric control board 11 and disc valve 3 still maintain in off state. Consequently, each magnet 25, 26 of a first solenoid operated valve 5 and a second solenoid operated valve 6 is de-energized, each spring 7, 8 thrusts the corresponding valve disc 13, 17 against respective valve seat 9, 10 thereby tightly closing the valve. This is to say, the first and second solenoid operated valves 5, 6, together with the third disc valve 3 will be closed very tightly while the faucet is closed.

Figure 2:
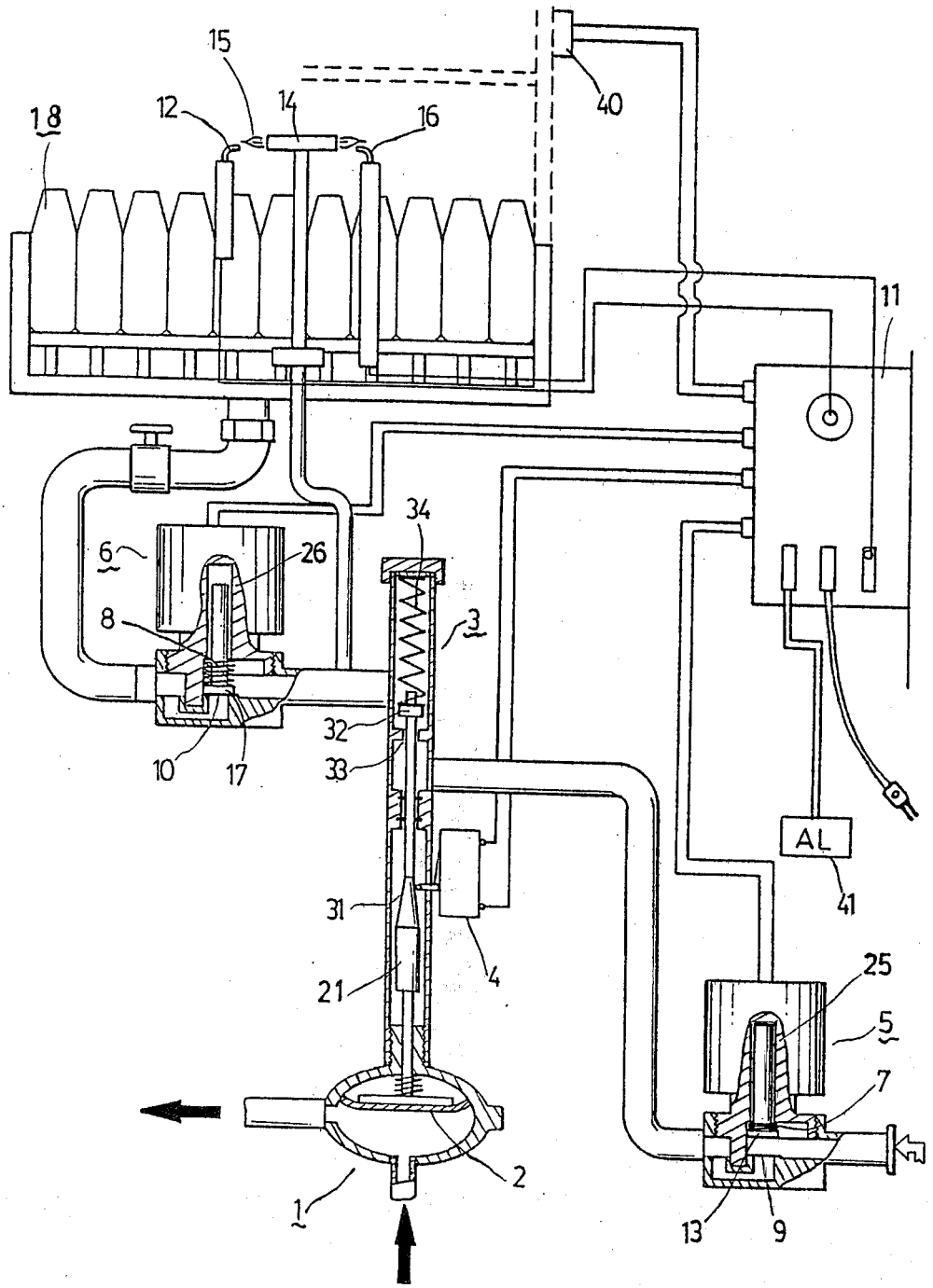
FIG. 2 is a schematic view as in FIG. 1, but in the other state, in which the diaphragm valve is exerted by the water pressure and the ignition of the pilot burner has been accomplished.

As shown in FIG. 2, as the faucet is opened, the elastomeric diaphram 2 is thrusted by the water pressure to drive the valve rod 21 upward. The upward movement of the valve rod 21 will thrust a disc 32 away from a valve seat 33 against a bias of a spring 34, and at the same time, by means of its conical portion 31, impart a force to actuate the microswitch 4 to on state. As the electric control board 11 is switched on, an igniter 12 begins to sparkle while another signal from the electric control board 11 energizes the magnet 25 of the first solenoid operated valve 5 to lift a valve disc 13 upward against the bias of the spring 7 to permit the gas flowing through the opened third valve 3 to a pilot flame nozzle 14 from which the gas will be ignited by the sparkling of the igniter 12.

Figure 3:
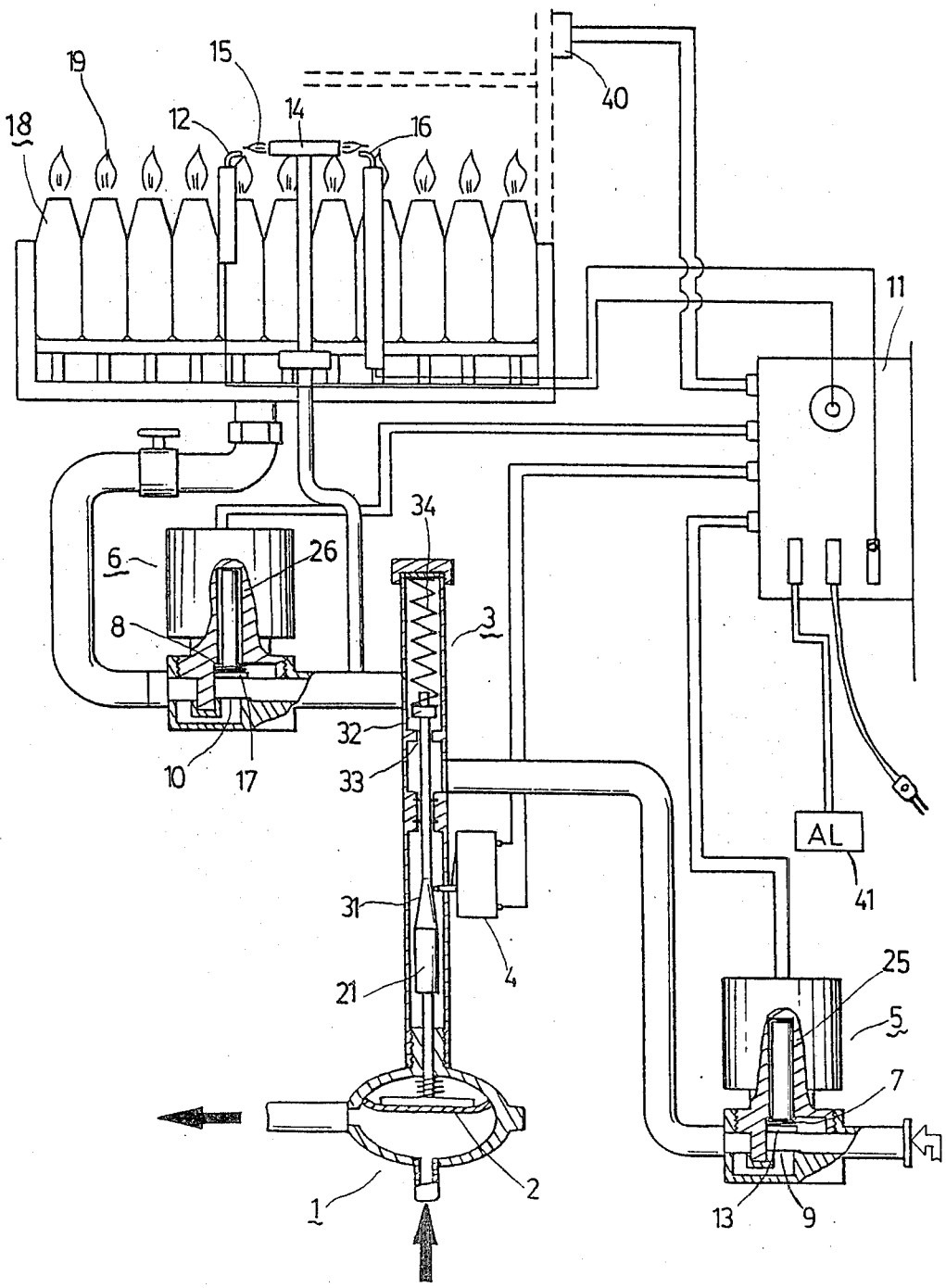
FIG. 3 is a schematic view as in FIG. 1, but in another state, in which the main burner is also fired.

As shown in FIG. 3, a sensor 16 is provided near the pilot flame nozzle 14 for detecting the presence of the pilot flame 15. In the presence of the flame 15, the impedence in the sensor 16 varies and induces the electric control board 11 to generate two signals, one for discontinuing the sparkling action of the igniter 12 and the other for energizing the magnet 26 of the second solenoid operated valves 6 to lift the valve disc 17 upward to permit the gas flowing to the main burner 18 from where the gas is burned by the pilot flame 15 and produce the main flame 19. After use, the faucet is closed and the valve rod 21 as well as the elastomeric diaphram 2 will revert to its original state as shown in FIG. 1.

If the pilot flame 15 and the main flame 19 are blown out undesirably by a strong wind, the sensor 16 will induce the electric control board 11 to send signals to deenergize the magnet 26 thereby closing the valve 6 and at the same time to continue sparkling of the igniter 12. The second solenoid operated valve 6 will not open until the gas from the pilot burner 14 is re-ignited. Hence, the possibility of explosive burning and suffocation can be minimized to be negligible.

Further, in shortage of electricity, the solenoid operated valve 5, 6 will automatically close. In case of damage of solenoid operated valves 5, 6 or the springs 7, 8 thereof, the valve discs 13, 17 will be pulled down by the gravity to abutt against the valve seat 9, 10 and close the valve.

The third valve 3 which is provided at the upstream of the pilot burner 14 and main burner 18 can cut the supply of gas when the microswitch 4 is abnormally self-switched on without any actuating movement of the valve rod 21.

A temperature detecting sensor 40 provided in the vicinity of main burner 18 can send a signal to the electric control board 11 to excite an alarm 41 and cut the electricity automatically, in case of overheating of the main burner 18.

With the invention thus explained, it has to be noted that many variation and modifications can be made without departing from the spirit of the preferred embodiment. Therefore, it is intended that the scope of the present invention be defined by the appended claims.

I claim:

1. An automatic safety gas heating device for water heating comprising: a valve rod externally connected to a diaphragm valve which is exerted upon by the pressure of the water;

a microswitch for an electric control board, actuated by the movement of the valve rod;

a first and a second solenoid operated valves connected in series and which are separately provided in a first gas conduit communicating with nozzles of a pilot burner and a second gas conduit communicating with nozzles of a main burner, the first and second solenoid operated valves separately actuated by the electric control board;

a third valve provided in the first gas conduit and located between the first valve and being upstream of the nozzle of the pilot burner and the second valve, actuated by the movement of the valve rod;

an igniter provided near the nozzle of the pilot burner, and actuated by the electric control board; and a first sensor provided in the vicinity of the nozzle of the pilot burner for detecting the presence of a pilot flame and inducing the electric control board to send signals, whereby as the valve rod actuating the microswitch on and the third valve to open, the pilot flame will start to be produced while the first valve is actuated to open, immediately after the pilot flame is produced, the sensor will induce the electric control board to send a first electric signal to discontinue the sparking of the igniter, and to open the second solenoid operated valve and supply the gas to the main burner and ignited thereat; in the absence of the pilot flame, the sensor will induce the electric control board to send a second electric signal to continue the sparking of the igniter, and to deactuate the second solenoid operated valve and stop the gas supply to the main burner.

2. An automatic safety gas heating device according to claim 1, in which the third valve has a valve disc which is thrusted to open by the valve rod against a bias.

3. An automatice safety gas heating device according to claim 1 or 2, in which the two solenoid operated valves are so oriented that if the electric control board runs out of electricity, the solenoid operated valves will be in a closed state due to the force of gravity.

4. An automatic safety gas heating device according to claim 3, in which a temperature detecting sensor is provided in the vicinity of the main burner for sending a signal to an alarm and simultaneously switching the electric control board off when the temperature is beyond a predetermined value.

* * * * *